United States Patent [19]

Zaccaria

[11] Patent Number: 4,476,639

[45] Date of Patent: Oct. 16, 1984

[54] NO LACE SHOE WITH ADJUSTABLE STRAP FASTENING MECHANISM

[75] Inventor: Gary S. Zaccaria, Sandy, Utah

[73] Assignee: Inventor's Technology Corporation, Salt Lake City, Utah

[21] Appl. No.: 517,942

[22] Filed: Jul. 28, 1983

Related U.S. Application Data

[63] Continuation-in-part of Ser. No. 415,645, Sep. 7, 1982.

[51] Int. Cl.[3] ..... A43B 5/00; A43B 11/00

[52] U.S. Cl. ..... 36/114; 36/51; 36/50

[58] Field of Search ..... 36/11.5, 50, 51, 54, 36/119, 115, 114, 128, 129, 52

[56] References Cited

U.S. PATENT DOCUMENTS

| | | | |
|---|---|---|---|
| 481,299 | 8/1892 | Daggett . | |
| 2,642,677 | 6/1953 | Yates | 36/11.5 |
| 3,037,303 | 6/1962 | Steuer | 36/51 |
| 3,555,706 | 1/1971 | Edmonds | 36/2.5 |
| 3,626,610 | 12/1971 | Dassler | 36/50 |
| 4,079,527 | 3/1978 | Antonious | 36/51 |
| 4,080,745 | 3/1978 | Torrance | 36/50 |
| 4,200,997 | 5/1980 | Scheinhaus et al. | 36/11.5 |
| 4,215,493 | 8/1980 | Antonious | 36/51 |
| 4,267,649 | 5/1981 | Smith | 36/101 |
| 4,282,657 | 8/1981 | Antonious | 36/50 |
| 4,308,672 | 1/1982 | Antonious | 36/50 |
| 4,324,412 | 2/1982 | Anderson et al. | 36/100 |
| 4,333,247 | 6/1982 | Marinelli | 36/11.5 |

FOREIGN PATENT DOCUMENTS

| | | | |
|---|---|---|---|
| 57170 | 8/1982 | European Pat. Off. | 36/115 |
| 61971 | 10/1982 | European Pat. Off. | 36/115 |
| 2516762 | 5/1983 | France | 36/115 |
| 321 | of 1910 | United Kingdom | 36/50 |

*Primary Examiner*—Werner H. Schroeder
*Assistant Examiner*—Steven N. Meyers
*Attorney, Agent, or Firm*—K. S. Cornaby

[57] ABSTRACT

A shoe with an adjustable strap fastening mechanism having a pull strap which is secured at one end to the insole of the shoe and disposed in wrap-around fashion about a wearer's foot from one side over the instep and the dorsum of the foot to the opposite side, and then beneath the wearer's foot through the structure of the shoe to a hook and pile fastening assembly. The pull strap may be pulled, and thereby cinched about the wearer's foot, to a desired comfortable tautness which is adjustable, which secures the shoe to the wearer's foot and which provides adjustable arch support.

38 Claims, 7 Drawing Figures

NO LACE SHOE WITH ADJUSTABLE STRAP FASTENING MECHANISM

RELATED CASE

This application is a continuation-in-part of my application entitled "No Lace Athletic Shoe With Adjustable Strap Fastening Mechanism," Ser. No. 415,645, filed Sept. 7, 1982.

FIELD OF THE INVENTION

This invention relates generally to shoes and the fastening mechanism used to secure the shoe to a foot, and more particularly to adjustable fastening mechanisms used in conjunction with athletic shoes.

BACKGROUND OF THE INVENTION

The development of shoes has been a gradual process over the years. As more was learned about the foot and its needs for walking, standing, running, etc., various features were developed. For example, there was a time when there was no design distinction made between right and left shoes, they were simply made the same. Now, shoes are much more comfortable and contour the foot much more closely than they did centuries ago. We also now have shoes for various purposes: shoes to provide style and elegance; shoes to provide support; casual shoes; corrective shoes; hiking shoes; running shoes; and many more. Each of the various types of shoes have different features to correspond to the uses for the shoe which distinguish them one from another.

It has been said that a person's feet are the most abused part of their body. Thus, naturally, shoes play an important role in either causing the abuse or preventing unnecessary abuse. One time in which the potential for abuse is extremely high is when a person actively participates in a sport. During active sport participation, an athlete's feet and his shoes take a tremendous beating. Moreover, in many instances, the injuries an athlete suffers can be traced directly to improperly fitted shoes, a shoe failure or inadequacy, or use of the wrong type of shoe. Consequently, there is a great deal of interest in improvements to athletic shoes of all types. The shoe industry is continually striving to find improvements that will add proper support to the foot and reduce the likelihood for injury. In short, the proper pair of comfortable, well-fitted shoes has become the most critical part of an athlete's equipment.

In recent years, due to the increased awareness for physical fitness and participation sports, a considerable amount of research, development and testing has been devoted to improving all types of athletic shoes. In particular, running shoes have received considerable attention because jogging and road racing has become increasingly more popular. Accordingly, the running shoe industry has blossomed and great strides have been made in improving running shoes.

New light-weight materials have been used to reduce the overall weight of the shoe and to absorb moisture by drawing it away from the foot. Breathable materials have been used to provide ventilation to the foot thereby increasing comfort. Resilient materials for absorbing the shocks normally imparted to the foot, leg or body of the wearer have also been used. Shoe design has become more streamline because new flexible materials can be used to contour the foot closely. Special insole inserts and arch supports have been developed to provide added support for persons requiring such. Improvements have been made in the design and the cut of a shoe to add support where needed or to make the shoe fit more comfortably.

Numerous fastening means have also been developed to improve the way in which the shoe is secured to the foot. The development of fastening assemblies which utilize a hook and pile or Velcro-type fastening material (see, for example, U.S. Pat. No. 4,282,657 entitled "Heel Restraint With an Adjustable and Flexible Closure Assembly for Shoes," issued to Anthony Antonious Aug. 11, 1981 which illustrates a number of fastening assemblies for securing the shoe to the foot) are of particular interest to the athletic shoe industry because such fastening assemblies are flexible, light-weight, and adjustable.

Further, the use of laces in shoes has always had certain drawbacks. Laces are not resilient and they sometimes stretch during use which permits the foot to move. Laces break or become untied and can present a hazard to the wearer when such occurs. The tongue of the shoe is frequently wrinkled or displaced as the shoe laces are tightened so that distracting or even painful discomfort may result during use. Also, because a shoe never fits exactly the same way twice, a shoe laced comfortably one way at one time may cause discomfort or injury on another occasion.

Various types of shoes have been developed to eliminate the use of laces; but with respect to active sport shoes, the developments have not proved entirely satisfactory. Typically, in order to eliminate the use of laces, support or the effectiveness of securing the shoe to the foot is sacrificed. The shoe of the present invention provides improved support with an adjustable fastening mechanism to secure the shoe to the foot without the use of laces. The athletic shoe and fastening mechanism of this invention is also designed to provide adjustable support to the foot and to reduce injuries related to use of an improperly fitted shoe.

An object of this invention is to provide an adjustable strap fastening mechanism for a shoe without shoe laces, shoe lace eyelets or a tongue; said shoe having a resilient "v" cut section or gore which expands to facilitate putting on or taking off the shoe.

Another object of this invention is to provide a shoe having an adjustable strap fastener mostly encased within the shoe in a wrap-around fashion which provides support to the foot when pulled comfortably taut.

A further object of the present invention is to provide a shoe having an adjustable strap fastener which will comfortably secure the shoe to the foot without the discomfort and disadvantages of tongue and lace fastening mechanisms.

Still another object of the present invention is to provide a shoe which eliminates the annoyance, interruption, and danger of untied and dragging shoe laces.

Another object of the present invention is to provide a shoe which provides adjustable support to the arch of the foot via an adjustable strap fastener which encircles the arch and the instep of the foot in comfortable securing engagement.

A further object of the present invention is to provide a shoe which can be adjusted for support and secured to the foot with a single pulling motion.

Still another object of the present invention is to provide a shoe with an adjustable strap fastening mechanism which is economical, light-weight, durable in use and easy to construct.

These and other objects and features of the present invention will become more fully apparent from the following description and appended claims taken in conjunction with the accompanying drawings.

SUMMARY OF THE INVENTION

These objects are achieved by an improved shoe having an adjustable strap fastener which comprises a pull strap secured to an insole for the shoe, a "v" cut section or gore, sole strap channels and an insert groove in the outer sole of the shoe, and an adjustable hook and pile fastening assembly. The pull strap, which is preferably made of a resilient material such as nylon or the like, has one end securely fixed to the insole of the shoe and is wrapped from one side of the wearer's foot over the instep to the opposite side of the foot. Such wrapping of the pull strap can be over the exterior or the upper of the shoe or even between layers of the upper. In the latter instance, it is preferred that the pull strap be threaded through a strap casing which is sewn within the upper of the shoe. Such a strap casing preferably has a two piece slidably overlapping construction which enables the strap casing to expand and contract as a foot is inserted into or removed from the shoe.

After passing over the foot, the pull strap is threaded through a sole strap channel into the insert groove in the outer sole of the shoe and exits through another sole strap channel. The pull strap is free to move slidably within the insert groove so that it can be pulled tight before securing the pull strap to the shoe.

The adjustable hook and pile fastening assembly comprises a hook portion which is sewn to the upper of the shoe and a pile portion which is sewn to the pull strap. In the case where the pull strap passes over the exterior of the upper, the hook portion can be sewn so as to provide a pass-through pocket for the pull strap.

The insertion of a wearer's foot into the shoe is facilitated by the "v" cut section which has a Spandex or other resilient web which permits the "v" cut section to expand as the foot is inserted and to contract once the foot is inserted.

After the foot is inserted, the wearer can secure his foot within the shoe by pulling on the adjustable strap fastener and engaging the hook and pile fastening assembly. In this manner, the pull strap is pulled taut and secured thereby grasping the foot in a wrap-around supporting fashion. The wrap-around support provided not only secures the foot within the shoe without the use of a lace and tongue assembly, but also provides adjustable arch support in a fashion approximating an elastic bandage wrap. Thus, the concerns created by the tongue and lacing for a conventional shoe are eliminated. Also, injuries attributable to inadequate arch support are significantly reduced or eliminated and the shoe can be comfortably and safely used by wearers having a high or low arch without relying solely on the arch support provided by the insole or arch support inserts.

BRIEF DESCRIPTION OF THE DRAWINGS

For a more complete understanding of this invention, reference should now be made to the embodiment illustrated in greater detail in the accompanying drawings and described below. In the drawings.

DETAILED DESCRIPTION OF THE PREFERRED EMBODIMENT

Figure 1:
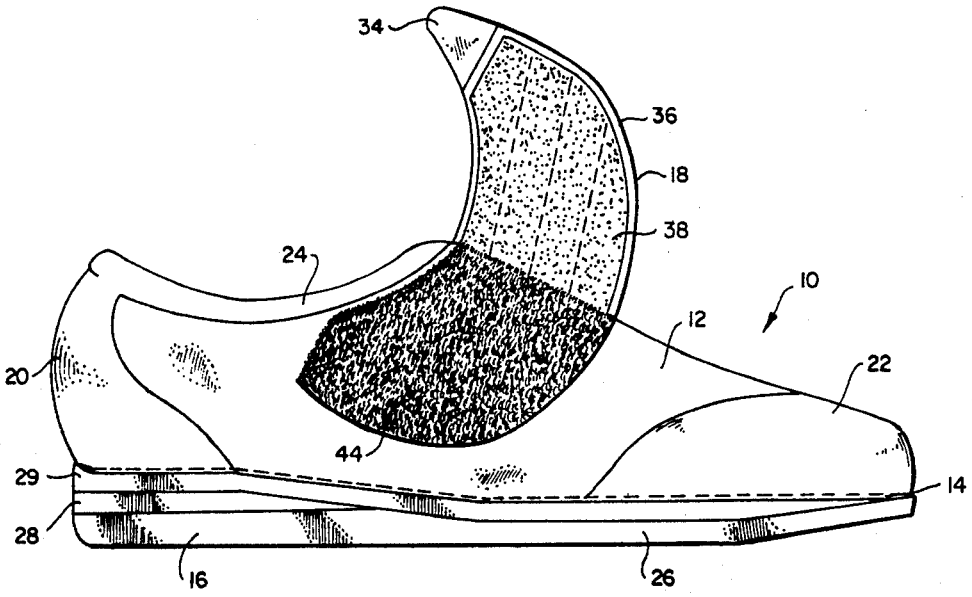
FIG. 1 is an elevational view of the right side exterior of a right shoe showing the partially closed adjustable strap fastener and the hook and pile fastening assembly.

Referring to the drawings, wherein like parts are given the same reference numeral, the shoe 10 of the present invention has an upper 12, an insole 14, an outer sole 16, and an adjustable strap fastener 18. The upper 12 of the shoe 10 comprises a heel 20, a toe 22, and a collar 24. The outer sole 16 is comprised of a plurality of layers, a base layer 26, a heel wedge 28 and an upper layer 29. The insole 14 of the shoe 10 is disposed interior to the upper 12 and upon the upper layer 29.

The shoe 10 shown and described is of typical shoe construction and may be of any known design and may be adorned with any compatible decorative attachment or indicia. Further, it should be understood that this invention is not limited to running or athletic shoes, but may be used with most types of shoes with or without laces, such as dress shoes, hiking boots, work boots, etc. Thus, the shoe 10 may be constructed of any of a number of materials or fabrics.

Figure 2:
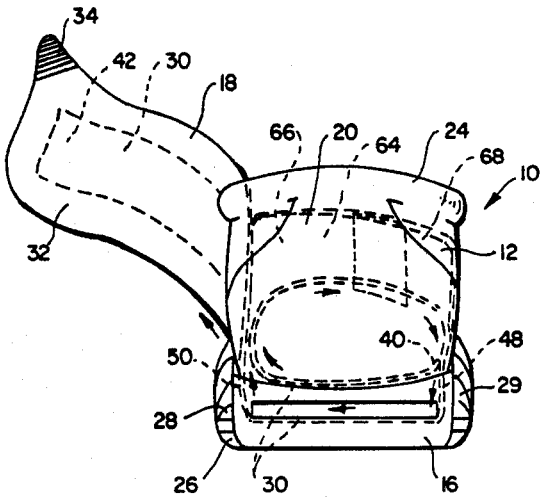
FIG. 2 is an elevational view of the rear or heel of a right shoe showing the partially closed adjustable strap fastener and a designation of the path of the pull strap in dashed lines and with directional arrows.

In the preferred embodiment, the adjustable strap fastener 18 comprises a pull strap 30, a strap shieldpiece 32 with a strap grip 34, a strap support layer 36, and a pile lining 38. The pull strap 30 has a connecting end 40 and a fastening end 42. Attached about the fastening end 42 of the pull strap 30, as shown in FIGS. 1 and 2, are the strap shieldpiece 32, the strap support layer 36 and the pile lining 38. The strap support layer 36 is preferably sewn into the adjustable strap fastener 18 to provide and maintain some form, rigidity and durability. The pile lining 38 is of the type used in a hook and pile fastening assembly, such as Velcro. The adjustable strap fastener 18 is preferably constructed as follows. The strap support layer 36 is cut or shaped to the same pattern as the adjustable strap fastener 18 and is disposed as a layer between the strap shieldpiece 32 and the pile lining 38. The pull strap 30 is sandwiched between the strap support layer 36 and the pile lining 38 in position where it is sewn or attached with adhesive into the adjustable strap fastener 18. The pile lining 38 is sewn or adhered to the underside of the adjustable strap fastener 18 so as to face the upper 12 of the shoe 10.

As shown in FIG. 1, a hook material 44 is attached to the upper 12 of the shoe 10 in register with and positioned to receive the pile lining 38 of the adjustable strap fastener 18. The hook material 44 is of the type used in a hook and pile fastening assembly, such as Velcro, so that when the pile lining 38 is brought into contact with the hook material 44 they join in locking engagement. In this manner, the adjustable strap fastener 18 adjustably secures the shoe 10 on the foot of a wearer (not shown).

Turning now to FIG. 2, it is shown that the pull strap 30 of the adjustable strap fastener 18 is disposed in wrap-around fashion. The pull strap 30 encircles the wearer's foot by passing from beneath the foot, over the instep, across the dorsum of the foot, through the structure of the shoe 10 subtending the foot, and fastening across the upper 12 of the shoe 10.

Figure 6:
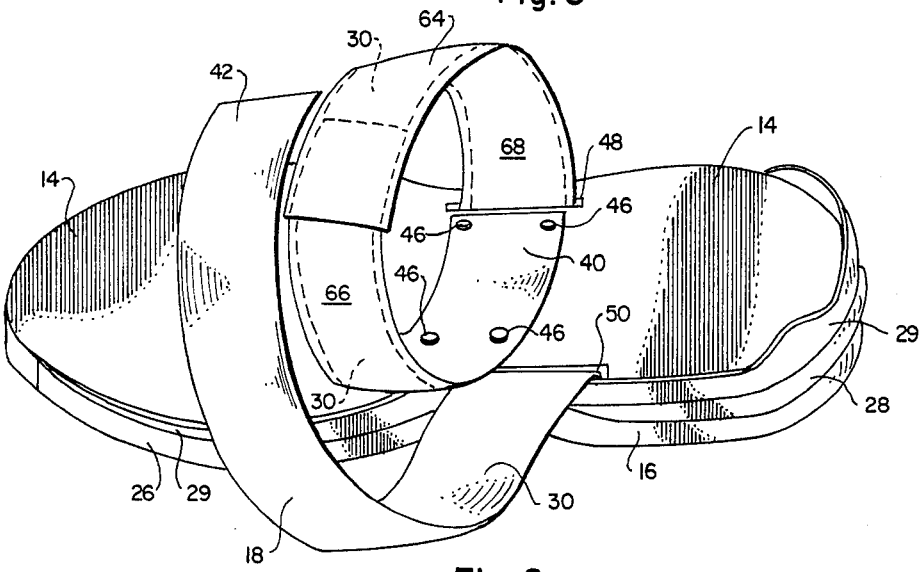
FIG. 6 is a perspective view of the sole and insole structure of a right shoe with the upper of the shoe omitted to show the attachment of the strap to the insole, and the wrap-around path of the pull strap about a foot (not shown) and through the sole of the shoe.

The connecting end 40 of the pull strap 30 is securely attached to the insole 14 of the shoe 10 (as shown in FIG. 6) by fasteners 46. The fasteners 46 may be of any suitable type; although surface-flush rivets are shown, it should be understood that any fastener may be used. Stitching or even an adhesive could certainly be used so long as they are durable to pulling force and do not create a roughness on the insole 14 that can rub or irritate the sole of the wearer's foot. In constructing the shoe 10, it is preferred that the pull strap 30 first be threaded through the upper 12 of the shoe 10 or threaded between the layers of material which make up the upper 12 of the shoe, as will be described with more particularity below. The upper 12 and the outer sole 16 may then be joined in construction by conventional shoe last means and methods. The pull strap 30 is then adjusted for position and attachment to the insole 14 by using the fasteners 46.

Figure 5:
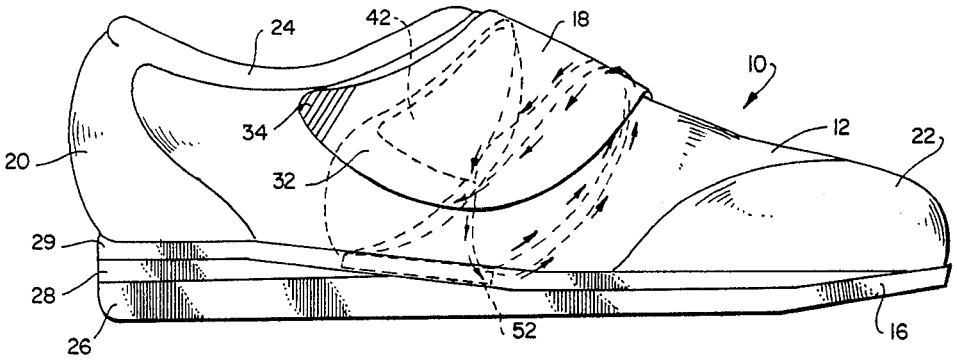
FIG. 5 is an elevational view of the right side exterior or a right shoe showing a closed adjustable strap fastener and a designation of the path of the pull strap in dashed lines and with directional arrows which illustrates that the pull strap passes through a strap channel opening into an insert groove outlined by broken lines.

From the secured connecting end 40, the pull strap 30 preferably passes beneath the foot to the arch of the foot and wraps across the instep and the dorsum of the foot to the opposite side of the foot (see the arrows in FIGS. 2 and 5 designating the direction of the wrap). From there the pull strap 30 passes beneath the foot through the structure of the shoe 10. In the preferred embodiment, a channel entry opening 48 and a channel exit opening 50 is provided in the insole 14 and the upper layer 29 of the outer sole 16 for the shoe 10. Thus, the pull strap 30 is threaded through the channel entry opening 48 into a channel 52 in the outer sole 16 of the shoe 10 and it exits the channel 52 through the channel exit opening 50. Upon exiting the channel exit opening 50, the pull strap 30 engages the strap shieldpiece 32, strap support layer 36 and the pile lining 38 which are securely attached to the pull strap 30 by securing stitching 53 or the like. In this manner, the adjustable strap fastener 18 is capable of securing the shoe 10 on the wearer's foot with an upward pulling motion on the strap grip 34 and engaging the pile lining 38 with the hook material 44. The pulling motion on the strap grip 34 imparts pulling force to the pulling strap 30 and cinches the pulling strap 30 about the foot to the desired tautness. Also, the wrap-around pull strap 30, when pulled comfortably taut, provides a supporting cradle or saddle in which the arch of the foot rests. This supporting cradle or saddle conforms to the contour of the arch, whether the arch is a high arch or a low arch.

Figure 7:
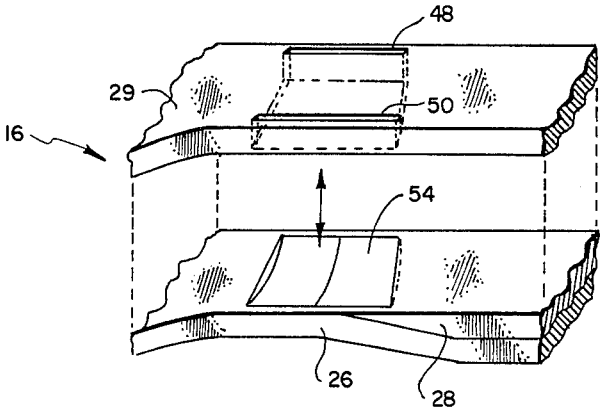
FIG. 7 is an exploded, broken away view of the upper and lower portions of the outer sole of a shoe showing the strap channel openings and the insert groove through which the pull strap passes.

The pull strap 30 is free to move through the channel entry opening 48, channel exit opening 50 and the channel 52. This assemblage provides tolerance for the free movement and insertion of the pull strap 30. The channel 52 is defined by a base insert groove 54 into which a channel base insert (not shown) which conforms to the shape of the insert groove 54 and which may be placed into the insert groove 54. This channel base insert cooperates with an opening insert (also not shown) which conforms to the shape of and is fitted into the channel entry opening 48 and the channel exit opening 50 (see FIG. 7). When the opening insert mounts into the channel base insert, a clearance tolerance is provided for the pull strap 30. It is preferred that the channel base insert and the opening insert be made of a hard, smooth material, such as a plastic, so that unnecessary rubbing wear to the insole 14 and outer sole 16 caused by pulling on the pull strap 30 can be avoided. In construction, after the channel base insert and the opening insert are inserted as described, the layers of the outer sole 16 are then bonded together by conventional methods to form a single outer sole 16. It should be understood, however, that the channel base insert and the opening insert need not be used so long as the pull strap 30 slides freely through the channel 52.

Figure 3:
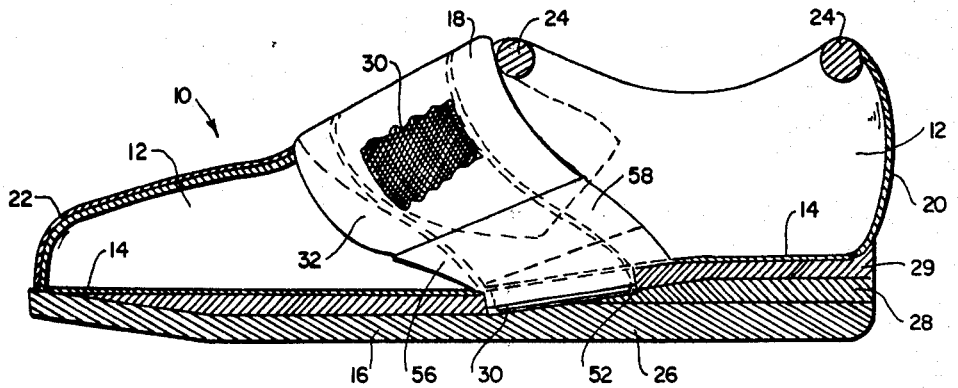
FIG. 3 is an elevational longitudinal section view of the inside right side of a right shoe showing the full adjustable strap fastener and cut-away view of the pull strap within the adjustable strap fastener.

After exiting the channel exit opening 50, the pull strap 30 passes to the exterior of the shoe 10. This can be through the upper 12 or, with slight modification to the channel 52, through the outer sole 16. It is preferred, however, that the pull strap 30 pass through an opening in the upper 12 of the shoe 10 near the arch. With this preferred embodiment, it is also preferred that a coverpiece 56 is provided to shield the opening from dirt or grit (See FIG. 3). The coverpiece 56 is sewn or otherwise attached to the shoe 10 so as to form a pocket 58 into which the adjustable strap fastener 18 is snuggly inserted for slidable movement. In this manner, when the adjustable strap fastener 18 is pulled for adjustment and fastening, it does not pull completely out of the pocket 58 and expose the pull strap 30 to view. This provides a shield against undesirable dirt or grit entering the shoe 10 and an attractive external appearance to the shoe 10.

The pull strap 30 described may be constructed of any suitable durable material. It may have a degree of resilience or it may have only a portion of its length that has resilience. It is preferred that it be constructed of a durable, lightweight nylon material.

Figure 4:
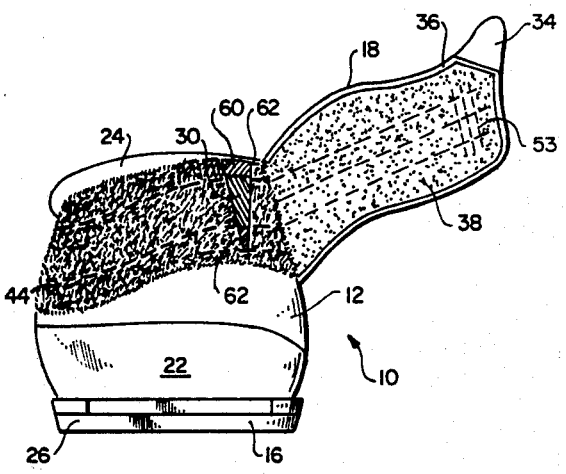
FIG. 4 is an elevational view of the front or toe of a right shoe showing a partially open adjustable strap fastener, detail of the "v" cut section and resilient webs and a view of the pull strap as it passes over the "v" cut section.

It is also preferred that the shoe 10 have one or more "v" cut sections 60 in the upper 12 of the shoe 10 extending from the collar 24, as shown in FIG. 4. The "v" cut section 60 may be located near the crest of the instep or more to the side of the upper 12. This "v" cut section 60 facilitates putting on and taking off the shoe 10 by expanding the collar 24 upon entry or exit of the wearer's foot. To add resilience to the "v" cut section 60, one or more resilient members 62 may be secured to the "v" cut section 60. Such resilient members 62 may be made of Spandex or any other suitable material. The manner in which two strip-like resilient members 62 are secured to the "v" cut section 60 is shown in dotted lines in FIG. 4. These resilient members 62 expand to allow the foot to be slipped into the shoe 10 and then contract to contour the foot. The resilient members 62 also expand to allow the foot to be slipped from the shoe 10 and then contract to close the collar 24 of the upper 12.

As described above, the pull strap 30 passes over the instep and the dorsum of the foot before passing through the channel 52 which subtends the wearer's foot. In passing over the instep and dorsum of the foot, the pull strap 30 may travel over the exterior of the upper 12 or it may travel between the layers of material which make up the upper 12.

In passing over the exterior of the upper 12, the pull strap 30 must first be threaded from interior to the upper 12 through an opening in the upper 12 to the exterior. This opening (not shown specifically) may be a separate opening or the "v" cut section 60 can be used for this purpose. To prevent the pull strap 30 from sliding up or down the back of the foot when exterior to the upper 12, it is preferred that the hook material 44 be attached, to the upper 12 to form a pass-through pocket for the pull strap 30. The pull strap 30 is free to move slidably within the pass-through pocket across the instep and the dorsum of the foot.

In passing internal of the layers of material which make up the upper 12, it is preferred that the pull strap 30 be enclosed in a casing 64 which facilitates the slidability of the pull strap 30 and which shields the upper 12 from rubbing wear. It is also preferred that the casing 64 comprise a first casing portion 66 and a second casing portion 68 which overlap one with the other in sliding engagement (see FIGS. 2 and 6) so that the overall length of the casing may be shortened when the pull strap 30 is pulled taut about the wearer's foot (such a casing 64 may also be used with the embodiment in which the pull strap 30 passes across the exterior of the upper 12). A pulling force on the pull strap 30 causes the first casing portion 66 to adjust to the contour of the wearer's foot by pulling the upper 12 toward the sole 16. This adjustment is provided because the first casing portion 66 inserts into the second casing portion 68 and as the pull strap 30 is pulled, the inserted first casing portion 66 slides into the second casing portion 68. The result of this movement is to secure the comfortable fit of the shoe 10 to the foot. For further comfort, a cushion or padding may be secured to the first casing portion 66 which moldably conforms to the contour of the wearer's arch.

It is preferred that the casing 64 be sewn into the upper 12 of the shoe 10 to prevent undesirable sliding of the casing 64. It is also preferred that the casing 64 be made of a material which would reduce or prevent wear on the fabric of the shoe upper 12 which would be created by the back and forth pulling movements of the pull strap 30 when the adjustable strap fastener 18 is adjusted to put the shoe 10 on or to take it off.

Also, when the pull strap 30 passes across the dorsum of the foot between layers of the upper 12, another preferred embodiment has the pull strap 30 traverse the "v" cut section 60, as illustrated in FIG. 4. This positions the pull strap 30 along the dorsum of the foot to secure the shoe 10 to the foot and to provide the degree of support to the arch of the foot anticipated by this invention.

In constructing the shoe 10 of the present invention, the "v" cut section 60 is cut in the upper 12 of the shoe 10. A full or partial interior lining of the shoe 10, if used, is matched to the pattern of the exterior of the upper 12 and the resilient members 62, preferably two strips, are sewn into the top and bottom of the "v" cut section 60 so as to leave space for the casing 64 to be inserted. The hook material 44 is then sewn on the upper 12 of the shoe 10. With the embodiment which has the pull strap 30 passing external to the upper 12, the hook material 44 is preferably sewn to the upper 12 in a fashion which creates the pass-through pocket through which the pull strap is eventually threaded. The coverpiece 56 is then sewn or otherwise attached near the arch point of the shoe 10 forming a pocket 58 with a slide opening for the adjustable strap fastener 18.

Conventional toe 22, heel 20 and collar 24 parts of the shoe 10, and decorative attachments are then sewn or otherwise attached to the upper 12. The casing 64 is then threadably inserted through the upper 12 and between the layers of material which make up the upper 12. The first casing portion 66 is inserted in the arch side of the upper 12 and receives in slidable overlapping engagement the second casing portion 68 which is inserted on the opposite side of the upper 12. This can be accomplished without great difficulty by using the "v" cut section 60 as an access point.

The outer sole 16 is then constructed in the manner described above so as to provide a passage comprising the channel entry opening 48, the channel exit opening 50 and the channel 52 through which the pull strap 30 may be freely threaded.

The pull strap 30 is threadably inserted through the casing 64 and then the outer sole 16. Once this is accomplished, the upper 12 is bonded or secured to the outer sole 16 by conventional methods. The pull strap 30 is positioned for attachment to the insole 16 and is then securely attached at its connecting end 40. The fastening end 42 of the pull strap is then secured to the strap shieldpiece 32, the strap support layer 36 and the pile lining 38 as described above.

In this manner, the pull strap 30 is disposed to fit about the shoe wearer's foot in a wrap-around fashion, as best illustrated in FIGS. 2, 5 and 6. The wearer puts the shoe 10 on by sliding his foot into the shoe 10 and pulling on the strap grip 34 which securely and adjustably cinches the pull strap 30 about the wearer's foot. When the degree of tautness desired is reached for comfortable support, the wearer causes the pile lining 38 and hook material 44 to contact in locking engagement. By using such a hook and pile fastening assembly, the pull strap tautness can be easily adjusted to the desired tautness by adjusting the length of the pull strap utilized. Although the hook and pile fastening assembly described is preferred, it should be understood that other types of adjustable fastening mechanisms can be used, such as a strap and buckle and the like. Also, the positions of the pile lining 38 and hook material 44 may be interchanged so that the pile lining 38 is secured to the shoe upper 12 and the hook material 44 is secured to the pull strap 30.

To release the adjustable strap fastener 18, the strap grip 34 is held between the thumb and forefinger and pulled in the direction contrary to the direction of pull to cinch tight the pull strap 30. The pile lining 38 and hook material 44 separate and the force on the pull strap is released. Then, due to flexibility provided by the "v" cut section 60, the shoe 10 can be removed by the wearer simply by slipping his foot out of the shoe 10.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A shoe having an upper, an insole and an outer sole, comprising:

fastening means for securing a wearer's foot within the shoe having first and second members which join in locking engagement; said first member connected to the shoe upper; and an adjustable strap fastener for supporting and securing the wearer's foot within the shoe and having said second member connected thereto proximate to a fastening end of said strap fastener; said strap fastener comprising:

a pull strap having a connecting end attached to the insole of the shoe and a distal end proximate to said fastening end of said adjustable strap fastener; said pull strap disposed to encircle the wearer's foot in a wrap-around manner by passing from one side of the foot over the instep to the opposite side of the foot, then by passing through the structure of the shoe subtending the foot, and by exiting the shoe for connecting said first and second members of said fastening means in locking engagement; and adjustment means for adjusting the tautness of said pull strap about the wearer's foot to provide adjustable support to the arch of the foot.

2. A shoe as set forth in claim 1 wherein the shoe further comprises a "v" cut section extending from the collar of the upper of the shoe which facilitates insertion of the wearer's foot into the shoe.

3. A shoe as set forth in claim 2 having a plurality of said "v" cut sections.

4. A shoe as set forth in claim 2 wherein said "v" cut section is disposed proximate to the crest of the instep of the upper of the shoe.

5. A shoe as set forth in claim 2 wherein said "v" cut section is disposed proximate to a side of the upper of the shoe.

6. A shoe as set forth in claim 2 wherein a resilient member is interposed between and connected to the opposite edges of said "v" cut section thereby imparting resilience to the collar of the upper of the shoe.

7. A shoe as set forth in claim 2 wherein said pull strap passes from the interior to the exterior of the shoe through said "v" cut section prior to passing through the structure of the shoe subtending the wearer's foot.

8. A shoe as set forth in claim 2 wherein said pull strap passes within the upper of the shoe and traverses through said "v" cut section when passing from one side of the foot over the instep to the opposite side of the foot.

9. A shoe as set forth in claim 1 wherein said pull strap is resilient.

10. A shoe as set forth in claim 1 wherein said fastening means comprises a hook and pile fastening mechanism.

11. A shoe as set forth in claim 10 wherein said first member of said fastening means is a hook member and said second member of said fastening means is a pile member of said hook and pile fastening mechanism.

12. A shoe as set forth in claim 11 wherein said hook member is attached to the upper of the shoe to define a pass-through pocket between said hook member and the upper of the shoe through which said pull strap slidably passes before passing through the structure of the shoe subtending the wearer's foot.

13. A shoe as set forth in claim 1 wherein said pull strap is within the upper of the shoe when passing from one side of the foot over the instep to the opposite side of the foot.

14. A shoe as set forth in claim 13 further comprising a casing enclosed about a portion of said pull strap intermediate of said connecting end and said distal end; said casing for reducing the wear on the upper of the shoe caused by the tightening and loosening of said pull strap during use of the shoe.

15. A shoe as set forth in claim 14 wherein said casing comprises a first casing member and a second casing member in slidably overlapping engagement whereby said casing slidably increases and decreases in length when said pull strap is tightened or loosened.

16. A shoe as set forth in claim 15 wherein said pull strap is resilient.

17. A shoe as set forth in claim 1 wherein said pull strap is exterior to the upper of the shoe when passing from one side of the foot over the instep to the opposite side of the foot.

18. A shoe as set forth in claim 17 wherein said pull strap is resilient.

19. A shoe as set forth in claim 1 wherein said adjustment means comprises a resilient portion of said pull strap.

20. A shoe as set forth in claim 1 wherein said adjustment means comprises an arrangement by which said first and second members of said fastening means may be joined in locking engagement in a plurality of positions thereby enabling the adjustment of the length of said pull strap.

21. A shoe as set forth in claim 20 wherein said arrangement is a hook and pile fastening assembly.

22. A shoe as set forth in claim 1 further comprising a channel disposed within the outer sole of the shoe through which said pull strap passes when passing through the structure of the shoe subtending the wearer's foot.

23. A shoe as set forth in claim 22 wherein said channel has an entrance opening and an exit opening through the insole of the shoe.

24. An ajustable strap fastening mechanism for securing and supporting a wearer's foot within a shoe which has an upper, an insole and an outer sole, comprising:

fastening means for securing the foot within the shoe having first and second members which join in locking engagement; said first member being connected to the shoe upper;

a pull strap having a connecting end attached to the insole of the shoe and a fastening end; said second member being connected to said pull strap proximate to said fastening end; said pull strap disposed to encircle the wearer's foot in a wrap-around manner by passing from one side of the foot over the instep to the opposite side of the foot, then through the structure of the shoe subtending the foot, and by exiting the shoe for connecting said first and second members of said fastening means in locking engagement; and adjustment means for adjusting the tautness of said pull strap about the wearer's foot to provide adjustable support to the arch of the foot.

25. An adjustable strap fastening mechanism as set forth in claim 24 wherein said fastening means comprises a hook and pile fastening mechanism.

26. An adjustable strap fastening mechanism as set forth in claim 25 wherein said first member of said fastening means is a hook member and said second member of said fastening means is a pile member of said hook and pile fastening mechanism.

27. An adjustable strap fastening mechanism as set forth in claim 26 wherein said hook member is attached to the upper of the shoe to define a pass-through pocket between said hook member and the upper of the shoe through which said pull strap slidably passes before passing through the structure of the shoe subtending the wearer's foot.

28. An adjustable strap fastening mechanism as set forth in claim 24 wherein said pull strap is within the upper of the shoe when passing from one side of the foot over the instep to the opposite side of the foot.

29. An adjustable strap fastening mechanism as set forth in claim 28 further comprising a casing enclosed about a portion of said pull strap intermediate of said connecting end and said distal end; said casing for reducing the wear on the upper of the shoe caused by the tightening and loosening of said pull strap during use of the shoe.

30. An adjustable strap fastening mechanism as set forth in claim 29 wherein said casing comprises a first casing member and a second casing member in slidably overlapping engagement whereby said casing slidably increases and decreases in length when said pull strap is tightened or loosened.

31. An adjustable strap fastening mechanism as set forth in claim 30 wherein said pull strap is resilient.

32. An adjustable strap fastening mechanism as set forth in claim 24 wherein said pull strap is exterior to the upper of the shoe when passing from one side of the foot over the instep to the opposite side of the foot.

33. An adjustable strap fastening mechanism as set forth in claim 32 wherein said pull strap is resilient.

34. An adjustable strap fastening mechanism as set forth in claim 24 wherein said adjustment means comprises a resilient portion of said pull strap.

35. An adjustable strap fastening mechanism as set forth in claim 24 wherein said adjustment means comprises an arrangement by which said first and second members of said fastening means may be joined in locking engagement in a plurality of positions thereby enabling the adjustment of the length of said pull strap.

36. An adjustable strap fastening mechanism as set forth in claim 35 wherein said arrangement is a hook and pile fastening assembly.

37. An adjustable strap fastening mechanism as set forth in claim 24 further comprising a channel disposed within the outer sole of the shoe through which said pull strap passes when passing through the structure of the shoe subtending the foot.

38. An adjustable strap fastening mechanism as set forth in claim 37 wherein said channel has an entrance opening and an exit opening through the insole of the shoe.

* * * * *